US012215699B2

(12) United States Patent
Sugimoto

(10) Patent No.: US 12,215,699 B2
(45) Date of Patent: Feb. 4, 2025

(54) CENTRIFUGAL BLOWER

(71) Applicant: SHINANO KENSHI KABUSHIKI KAISHA, Nagano (JP)

(72) Inventor: Takumi Sugimoto, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 0 days.

(21) Appl. No.: 18/532,522

(22) Filed: Dec. 7, 2023

(65) Prior Publication Data

US 2024/0240642 A1 Jul. 18, 2024

(30) Foreign Application Priority Data

Jan. 12, 2023 (JP) ..... 2023-003179

(51) Int. Cl.

| | |
|---|---|
| ***F04D 17/16*** | (2006.01) |
| ***F04D 25/06*** | (2006.01) |
| ***F04D 25/08*** | (2006.01) |
| ***F04D 29/42*** | (2006.01) |

(52) U.S. Cl.

CPC ..... *F04D 17/16* (2013.01); *F04D 25/0693* (2013.01); *F04D 25/08* (2013.01); *F04D 29/4226* (2013.01)

(58) Field of Classification Search

CPC ..... F04D 17/16; F04D 25/0693; F04D 25/08; F04D 29/4226

See application file for complete search history.

(56) References Cited

U.S. PATENT DOCUMENTS

| | | | | |
|---|---|---|---|---|
| 10,914,317 | B2 | 2/2021 | Nogamida et al. | |
| 11,242,855 | B2 | 2/2022 | Imai et al. | |
| 2008/0014085 | A1* | 1/2008 | Lin | G06F 1/20 415/214.1 |
| 2019/0003485 | A1 | 1/2019 | Nogamida et al. | |
| 2019/0178261 | A1* | 6/2019 | Kajikawa | H02K 5/207 |
| 2021/0003132 | A1 | 1/2021 | Imai et al. | |
| 2021/0095679 | A1* | 4/2021 | Uchino | F04D 25/08 |
| 2021/0239127 | A1* | 8/2021 | Uni | F04D 17/10 |
| 2022/0163051 | A1* | 5/2022 | Hsu | F04D 29/4226 |
| 2023/0045464 | A1* | 2/2023 | Yamasaki | H02K 11/33 |

* cited by examiner

*Primary Examiner* — Courtney D Heinle

*Assistant Examiner* — Andrew J Marien

(74) *Attorney, Agent, or Firm* — Stephen J. Weyer, Esq.; Stites & Harbison, PLLC

(57) ABSTRACT

A first fitting part P of a first case 4*a* and a second fitting part Q of a second case 4*b* are concave-and-protrusion fitted to each other, a first ridge 4*g* and a second ridge 4*i* in which center lines extend in parallel to an axial direction are overlapped with each other in a radial direction at wall surfaces of the first fitting part P and the second fitting part Q facing to each other, and the first ridge 4*g* and the second ridge 4*i* mesh with each other while top parts 4*g*1, 4*i*1 thereof pressing the wall surfaces facing to each other in the circumferential direction.

3 Claims, 11 Drawing Sheets

CENTRIFUGAL BLOWER

CROSS-REFERENCE TO RELATED APPLICATION

This application is based upon and claims the benefit of priority of the prior Japanese Patent Application No. 2023-003179, filed on Jan. 12, 2023, and the entire contents of which are incorporated herein by reference.

TECHNICAL FIELD

The present disclosure relates to a centrifugal blower used for, for example, a seat air-conditioning or an HVAC (Heating, Ventilation, and Air Conditioning) apparatus, etc.

BACKGROUND ART

For example, when a driver is in contact with a backrest or a seating part of a seat for a long period of time, such as during long-distance travel by driving a car, air which is high in temperature and humidity clings and discomfort increases.

Therefore, a seat air-conditioning apparatus to adjust high-temperature and humidity air which is likely to be accumulated mainly at the backrest portion and the seating portion is used.

As the seat air-conditioning apparatus, types of the seat air-conditioning apparatus exist in which air is blown out from a seat, and in which air is drawn in and discharged from a seat. Here, a seat air-conditioning apparatus of the drawing-in type for which an air-conditioning effect of higher comfortability can be expected is described. The drawing-in type air-conditioning apparatus sucks high-temperature and humidity air accumulated at the backrest portion and the seating portion to be removed from the area, and therefore, an air-conditioning effect can be achieved.

The seat air-conditioning apparatus described above is assembled to a vehicle seat, and it is conceivable that the seat air-conditioning apparatus is used in a harsh situation, such as where humidity changes due to perspiration of a person on board, and where the seat air-conditioning apparatus vibrates due to a step and an uneven surface on a traveling surface.

For example, an electric pump which achieves waterproof and less-vibration property, and is provided with a centrifugal fan which prevents rattling after assembly, is proposed. A first gasket is interposed between a stator and a motor housing, and a supporting member, and a second gasket is interposed between the supporting member and a substrate housing. The first gasket and the second gasket prevent water from entering through between the stator and the motor housing, and the supporting member, and between the supporting member and the substrate housing. Therefore, the waterproof performance is ensured. Moreover, even when vibration caused at the stator during actuation of a motor part is transmitted to the motor housing, this vibration can be absorbed by the first gasket and the second gasket, and therefore, the less-vibration performance is ensured.

Furthermore, the stator, the motor housing, and the substrate housing can be assembled to the supporting member by using a first snap-fit structure, a second snap-fit structure, and a third snap-fit structure, and therefore, assembly is easy (PTL 1: JP-B-6973432).

Moreover, a structure is proposed in which an upper casing and a lower casing of a centrifugal fan are coupled to each other with a supporting pillar attached therebetween. In detail, the supporting pillar is integrally formed with the upper casing by resin (PBT resin) molding at a flange part provided to an outer peripheral part of the upper casing, and a protrusion part is formed at a tip-end part of the supporting pillar. This protrusion part is inserted into a through-hole formed at a flange of the lower casing, and a tip-end part of the protrusion part projected from the through-hole is welded (for example, ultrasonic welding, vibration welding, laser welding, and the like), heat swaged, or the like. Therefore, the upper casing and the lower casing are joined to each other with the supporting pillar interposed therebetween. The upper and lower casings are resin molded and the weight is small, and vibration is suppressed while stiffness is increased by a rib being formed at each of the casings (PTL 2: JP-B-7043338).

SUMMARY OF INVENTION

Technical Problem

In PTL 1 described above, since the stator, the motor housing, and the substrate housing are assembled to the supporting member by using the first snap-fit structure, the second snap-fit structure, and the third snap-fit structure, the size is increased in an axial direction, thereby not being suitable for reducing thickness. For example, it cannot be adopted for a location where assembling space is limited, for example, in a vehicle seat. Moreover, since the gasket is assembled for waterproof, the number of components increases and a man-hour increases, which raises a manufacturing cost.

Moreover, like in PTL 2, when the upper casing and the lower casing made of resin are coupled to each other by welding, heat swaging, or the like, the coupled portion requires a volume to withstand mechanical stress during the welding or the heat swaging, and a man-hour for manufacture increases.

Solution to Problem

The present invention has been accomplished to solve the problem described above, and one object thereof is to provide a centrifugal blower in which easy assembly of a case body configured by combination of a first case and a second case is possible, and rattling of the case body after the assembly is prevented.

The present invention has the following configuration to achieve the above-described object.

A centrifugal blower includes a case body that accommodates therein a centrifugal fan and a motor which rotary drives the centrifugal fan, and draws in air from a radial-direction middle part of the case body and discharges compressed air from a radial-direction outer side of the case body. The case body includes a first case and a second case. The first case is assembled to cover the centrifugal fan, and provided with an intake opening part at a radial-direction middle part, and a first air blowing path formed at a radial-direction outer side. The second case axially supports the motor to be rotatable, and is provided with a second air blowing path formed on an outer side of an outer-peripheral end part of the centrifugal fan in a radial direction. The second air blowing path is combined with the first air blowing path. The case body is assembled by a first fitting part provided to the first case and a second fitting part provided to the second case being concave-and-protrusion fitted to each other, a first ridge and a second ridge in which center lines extend in parallel to an axial direction being overlapped with each other in the radial direction at wall surfaces of the first fitting part and the second fitting part facing to each other, and the first ridge and the second ridge meshing with each other while top parts thereof pressing the wall surfaces facing to each other in the circumferential direction.

As described above, at the facing wall surfaces of the first fitting part and the second fitting part, the first ridge and the second ridge in which the center lines extend in parallel to the axial direction are overlapped with each other in the radial direction, and the first ridge and the second ridge mesh with each other while top parts thereof pressing the wall surfaces facing to each other in the circumferential direction. Therefore, when the first fitting part and the second fitting part are concave-and-protrusion fitted to each other, rattling does not occur in the circumferential direction, the radial direction, and the axial direction of the case body.

At each of circumferential-direction both-side side walls of the first fitting part provided projectingly in a plate shape from an outer-peripheral edge part of the first case, the first ridge in which the top part has a curved-surface shape and continues in a thickness direction may be formed. At each of both-side standing walls of the second fitting part having a concave shape and to be fitted to the first fitting part, the second ridge in which a width is narrower at an opening end side, and gradually becomes wider toward a bottom part side, may be formed.

Therefore, only by the first case and the second case being overlapped with each other in the axial direction, the first ridge and the second ridge fit to each other while being in contact. Thus, rattling does not occur in the radial direction of the case body. The top parts of the first ridge and the second ridge press the wall surfaces facing to each other, and thus rattling does not occur also in the circumferential direction of the case body. The first ridge and the second ridge mesh with each other such that pressing force becomes the strongest at the fitted position, and thus rattling does not occur also in the axial direction of the case body.

A lead wire opening part from which a lead wire of the motor is led out may be formed by the first fitting part and the second fitting part being fitted together.

Therefore, when the lead wire opening part is formed by the first fitting part and the second fitting part being fitted together, only by the first ridge and the second ridge being formed at the outer and inner walls of the first fitting part and the second fitting part, rattling of the case body after assembly of the case body can be prevented from occurring without an additional member being provided.

The case body may be formed by the first case and the second case being overlapped with each other in the axial direction, and an elastically deformable lock piece provided to an outer-peripheral side part of the first case being locked to a lock part provided to an outer-peripheral side part of the second case.

Therefore, assembly can be achieved by snap-fit in which the first case and the second case are overlapped with each other in the axial direction, and the lock piece is elastically deformed to be locked to the lock part, which makes assemblability favorable. In addition, by the meshing between the first ridge and the second ridge being made more secured, the locking state between the lock piece and the lock part gets firmer, thus the locking state of the snap-fit can be reinforced.

Advantageous Effects of Invention

The centrifugal blower can be provided in which easy assembly of the case body configured by combination of the first case and the second case is possible, and rattling after the assembly is prevented.

DESCRIPTION OF EMBODIMENTS

Hereinafter, referring to the accompanying drawings, one embodiment of a centrifugal blower according to the present invention is described. First, an outline configuration of the centrifugal blower is described with reference to FIGS. 1 to 12. As a motor M, a brushless DC motor is used, and in this embodiment, an outer rotor type motor is used. Note that an internal rotor motor may be used.

Figure 1:
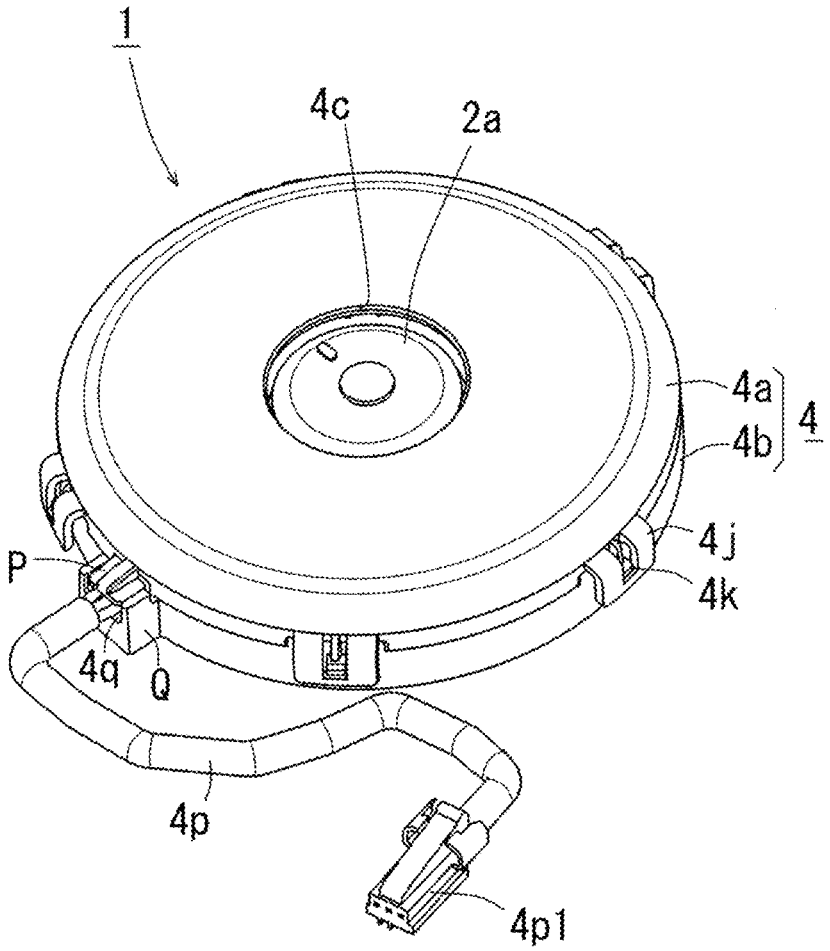
FIG. 1 is a perspective view of a centrifugal blower.

As illustrated in FIG. 1, in a centrifugal blower 1, a centrifugal fan 2 (see FIG. 2) and a rotor 3 (see FIG. 12) are assembled integrally, and the motor M which rotary drives these components is accommodated in a case body 4. As illustrated in FIG. 1, air is drawn in from a radial-direction middle part of the case body 4, and compressed air is discharged from a radial-direction outer side along the axial direction. As illustrated in FIG. 1, the case body 4 is formed by combination of a first case 4*a* which is assembled to cover the centrifugal fan 2, and a second case 4*b* which axially supports the motor M (the rotor 3 and a stator 5; see FIG. 12) to be rotatable. The first case 4*a* and the second case 4*b* are integrally assembled by elastically deformable lock pieces 4*j* provided to a plurality of positions of an outer-peripheral side part of the first case 4*a* respectively being locked to lock parts 4*k* provided to corresponding positions of an outer-peripheral side part of the second case 4*b* (snap-fit).

Figure 12:
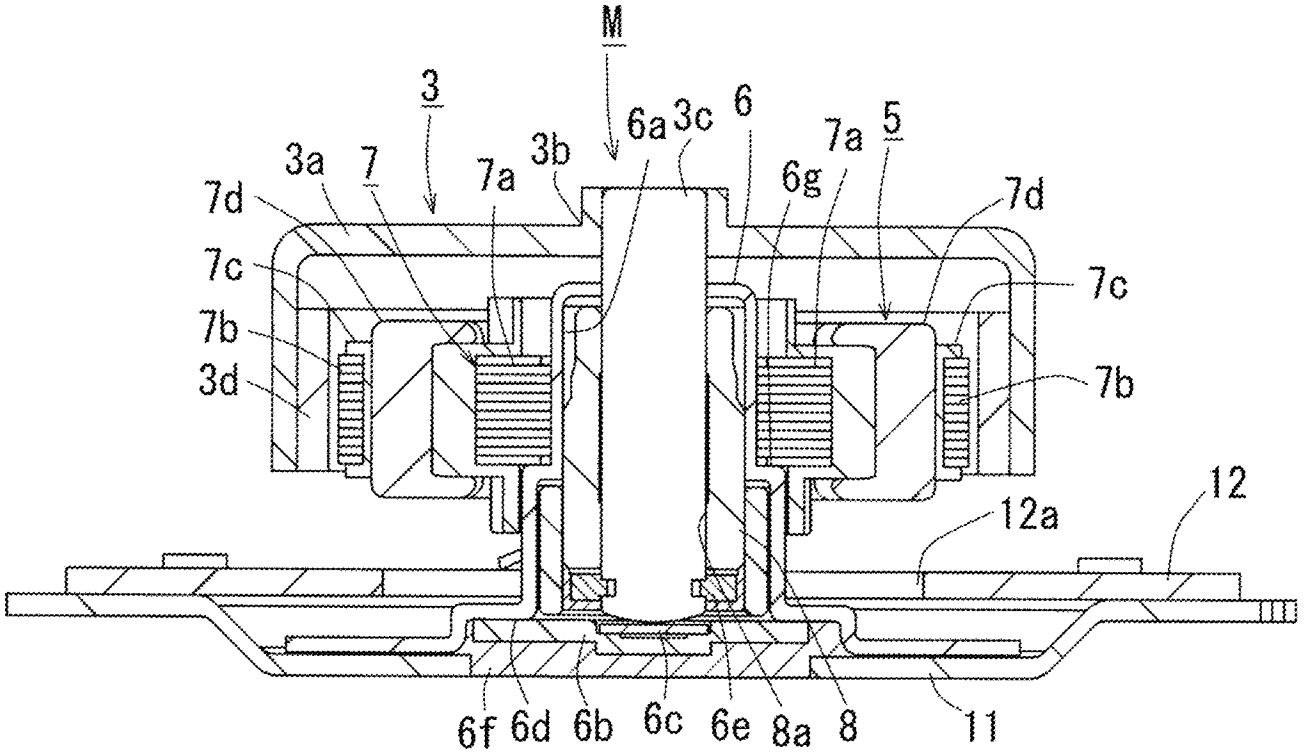
FIG. 12 is a vertical cross-sectional view of a drive source.

FIG. 12 illustrates a cross-sectional view of the motor M which is a drive source. As illustrated in FIG. 12, in the stator 5, a stator core 7 is adhesively fixed to an outer periphery of an axial-direction intermediate part of a stator housing 6 formed in a cylindrical shape. The stator core 7 is assembled by the stator housing 6 being inserted into a center hole of an annular core back part 7*a*. The stator core 7 is assembled while being abutted to a stepped part 6*g* provided to the stator housing 6, and being positioned in the axial direction. The stator core 7 is provided with a plurality of pole teeth 7*b* projecting toward the radial-direction outer side from the core back part 7*a*. A circumference of the pole teeth 7*b* is covered by an insulator 7*c*, and a motor coil 7*d* is wound therearound. A coil lead of the motor coil 7*d* is electrically connected to an terminal part of a motor substrate 12 by soldering. The motor substrate 12 is assembled to be overlapped on a base plate 11 in a state where the stator housing 6 is inserted into a substrate through-hole 12*a*.

In the rotor 3, one end of a rotor shaft 3*c* is integrally assembled, by one of press fit, adhesion, shrink fit, etc., or combination thereof, to a hub 3*b* of a rotor yoke 3*a* formed in a cup shape. An annular rotor magnet 3*d* magnetized to N pole and S pole, alternately, is assembled to an inner peripheral surface of the rotor yoke 3*a*. The rotor yoke 3*a* is insert molded together with an impeller 2*c*. The rotor shaft 3*c* is inserted into a cylinder hole 6*a* of the stator housing 6, and is press-fitted into a cylinder hole 8*a* of an oil-impregnant sintered bearing 8 press-fitted into the stator housing 6. An insertion end part of the rotor shaft 3*c* is supported by being abutted to a thrust bearing 6*c* supported by a closing member 6*b* which closes the cylinder hole 6*a* of the stator housing 6. The closing member 6*b* is integrally assembled while being abutted to a concave part 6*d* of the stator housing 6. Moreover, a retainer washer 6*e* is fitted to the rotor shaft 3*c* at a vicinity of the insertion end portion, and the rotor shaft 3*c* is retained in the axial direction. The closing member 6*b* is sealed by a sealing material 6*f* being filled into the concave part 6*d* of the stator housing 6.

Figure 2:
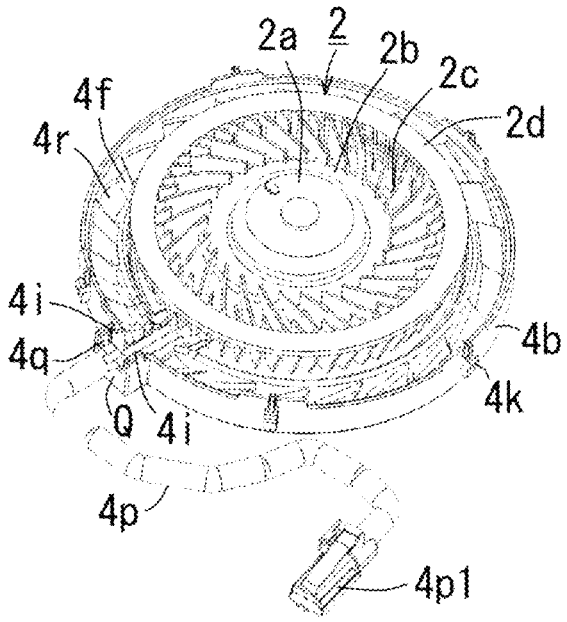
FIG. 2 is a perspective view of the centrifugal blower in FIG. 1 where a first case is removed.

As illustrated in FIG. 2, in the centrifugal fan 2, a main plate 2*b* which continues from a hub 2*a* on a radial-direction outer side is formed in a dome shape. Air drawn in from an intake opening part 4*c* opposed to the hub 2*a* of the centrifugal fan 2 can be compressed and sent out to an annular air blowing path provided at a radial-direction outer side, by the impeller 2*c* formed on the main plate 2*b*. A shroud 2*d* is formed at an outer-peripheral-side upper-end part of the impeller 2*c* to be connected annularly. Moreover, the hub 2*a* and the main plate 2*b* which continues thereto of the centrifugal fan 2 form a dome-shaped space part on the opposite surface side from the intake opening part 4*c*. In the dome-shaped space part, as illustrated in FIG. 12, the rotor 3 and the stator 5 of the motor M are accommodated to be overlapped with each other in the axial direction. Therefore, the centrifugal blower 1 can be made smaller and flatter than a centrifugal blower of the same size by an axial direction dimension of the centrifugal blower 1 being reduced.

Figure 4:
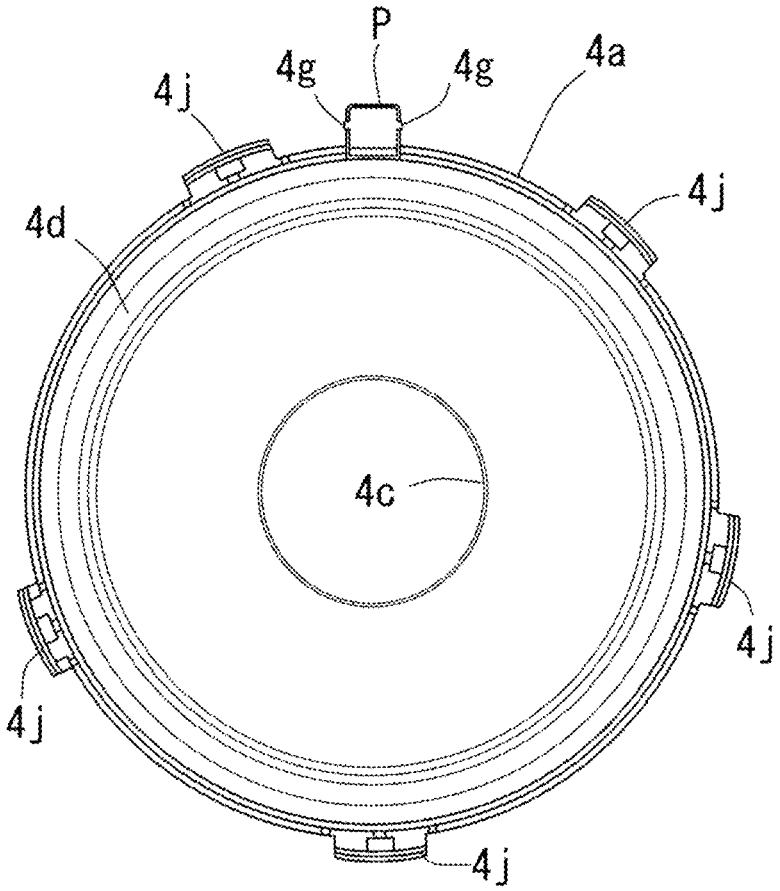
FIG. 4 is an internal plan view of the first case in FIG. 3.

As illustrated in FIG. 1, the intake opening part 4*c* is provided to a radial-direction middle part of the first case 4*a*, and as illustrated in FIG. 4, a first air blowing path 4*d* is formed at a radial-direction outer side. Note that the center of the intake opening part 4*c* is not required to strictly coincide with an axial line of the rotor shaft 3*c* of the motor M, as long as the position of the intake opening part 4*c* is near the radial-direction middle part of the case body 4, and the centrifugal fan 2 operates without lowering efficiency.

Figure 3:
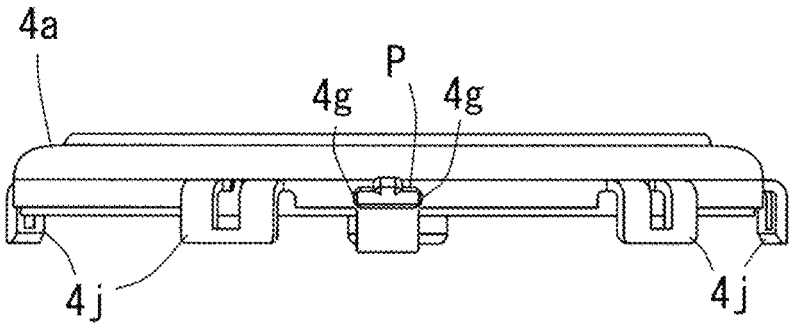
FIG. 3 is a front view of the first case in FIG. 1.

As illustrated in FIGS. 3 and 4, a first fitting part P of a plate shape is projectingly provided to an outer-peripheral edge part of the first case 4*a*. A first ridge 4*g* is provided to each of both circumferential-direction side surfaces of the first fitting part P such that a center line of the first ridge 4*g* is in parallel to the axial direction.

Figure 5:
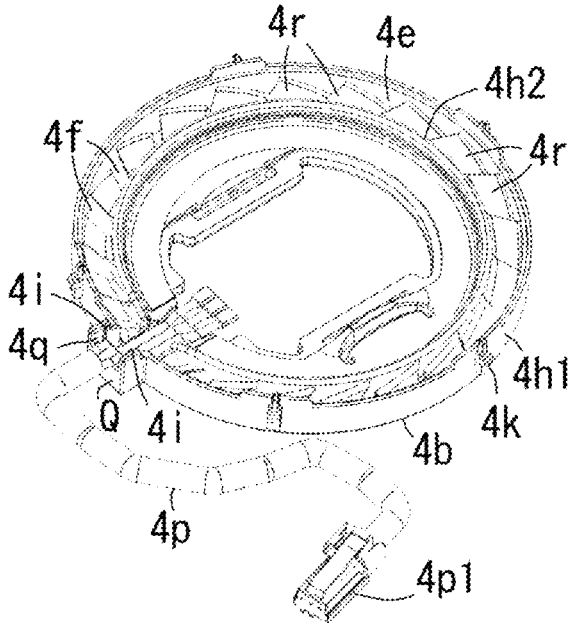
FIG. 5 is a perspective view of a second case and a wiring cable in FIG. 1.
Figure 6:
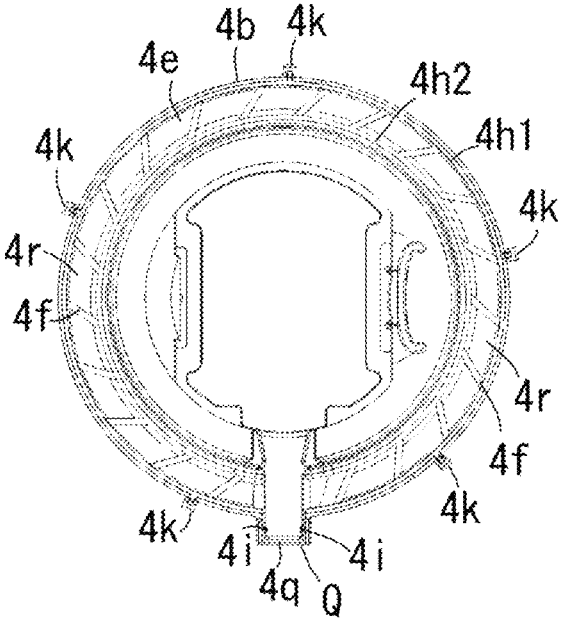
FIG. 6 is an internal plan view of the second case in FIG. 5.

As illustrated in FIGS. 5 and 6, a second air blowing path 4*e* to be combined with the first air blowing path 4*d* is formed at a radial-direction outer side of the second case 4*b*. The annular air blowing path is formed at the radial-direction outer side of the case body 4 by the first case 4*a* and the second case 4*b* being combined together. At a bottom-part outer peripheral side of the second case 4*b*, which becomes the second air blowing path 4*e*, discharge holes 4*f* to discharge pressurized and compressed air along the axial direction are bored at a plurality of positions in the circumferential direction. A plurality of diffuser panels 4*r* are installed between a bottom-part outer peripheral wall 4*h*1 and a bottom-part inner peripheral wall 4*h*2 provided to the bottom part of the second case 4*b*, and the discharge holes 4*f* are formed. The diffuser panels 4*r* discharge air which is discharged in the axial direction from the discharge holes 4*f* provided to the second air blowing path 4*e*, obliquely downwardly with respect to a rotational direction of the centrifugal fan 2, along an inclination of each diffuser panel 4*r*. As illustrated in FIG. 12, the base plate 11 which has a sheet-metal shape and covers a motor bottom part is assembled to the second case 4*b*. The stator housing 6 is resistance-welded and assembled integrally to the base plate 11. The motor substrate 12 is overlapped and assembled to the stator housing 6 in the state where the stator housing 6 is inserted into the substrate through-hole 12*a*. An energizing circuit is formed on the motor substrate 12.

Figure 7:
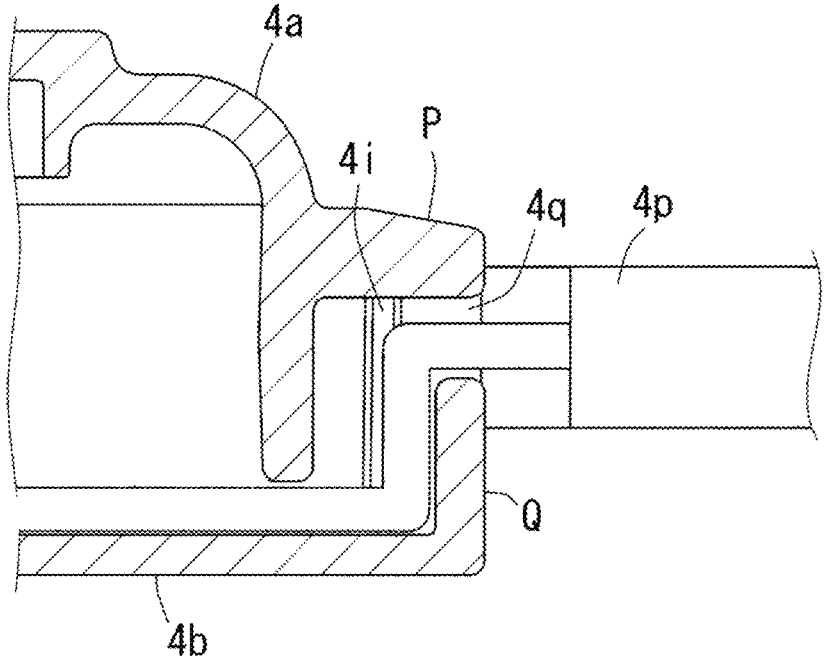
FIG. 7 is a cross-sectional view of a lead wire leading-out part of a case body.
Figure 8:
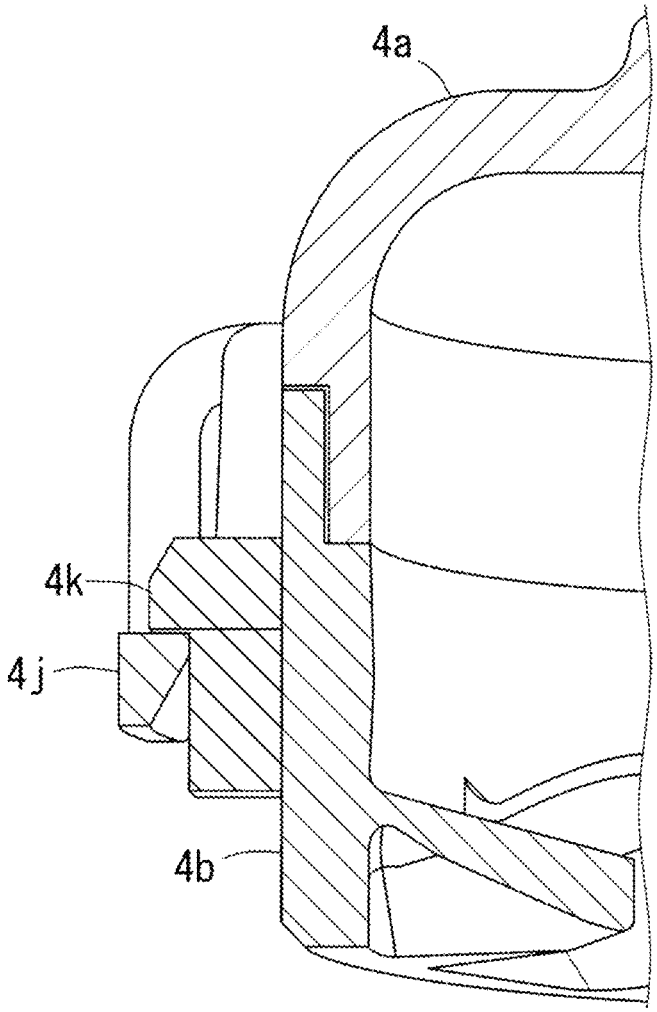
FIG. 8 is a cross-sectional view of a snap-fit structure of the case body.
Figure 9:
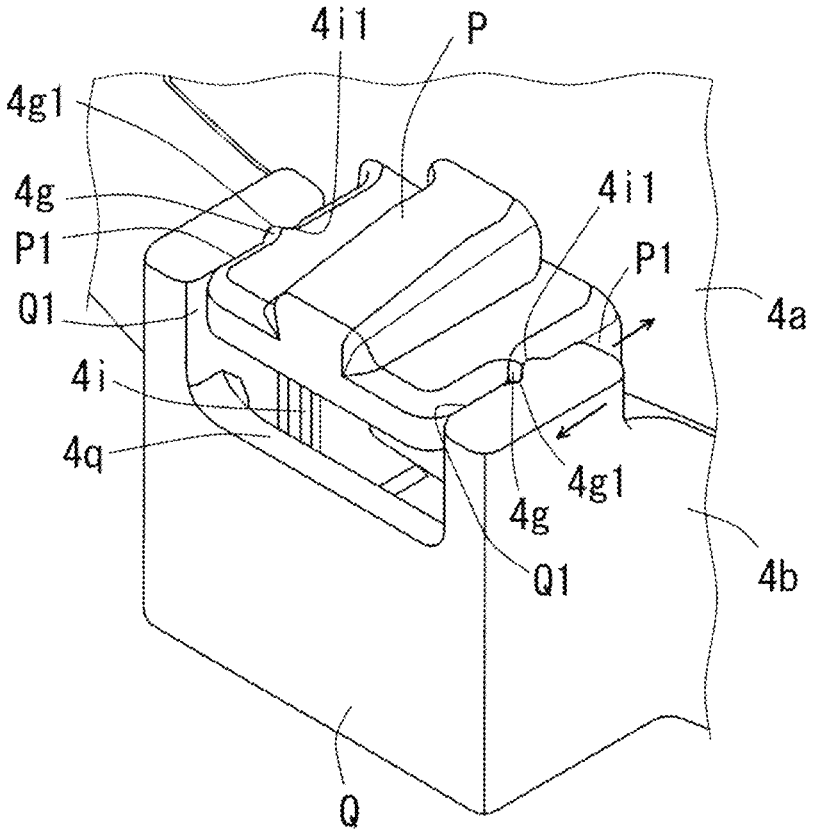
FIG. 9 is a perspective view of the lead wire leading-out part.

As illustrated in FIGS. 5 and 6, a second fitting part Q is projectingly provided to the outer-peripheral side part of the second case 4*b*. The second fitting part Q has a concave groove shape where standing walls are provided to both sides of a bottom part and an upper side of the second fitting part Q opens. On each of facing surfaces of both-side standing walls Q1 of the second fitting part Q, a second ridge 4*i* is provided such that a center line thereof is in parallel to the axial direction. When the first case 4*a* and the second case 4*b* are fitted together, the first fitting part P and the second fitting part Q fit to each other, the first ridge 4*g* and the second ridge 4*i* overlap with each other in the radial direction, and top parts of the first ridge 4*g* and the second ridge 4*i* mesh with each other while respectively pressing the facing wall surfaces in the circumferential direction. By the first fitting part P and the second fitting part Q fitting to each other, a lead wire opening part 4*q* from which a lead wire 4*p* of the motor is led out is formed (see FIG. 9). As illustrated in FIGS. 1 and 7, the lead wire 4*p* is led out from the lead wire opening part 4*q*. A connector terminal 4*p*1 for wiring connection is provided to a tip end of the lead wire 4*p*.

Figure 10:
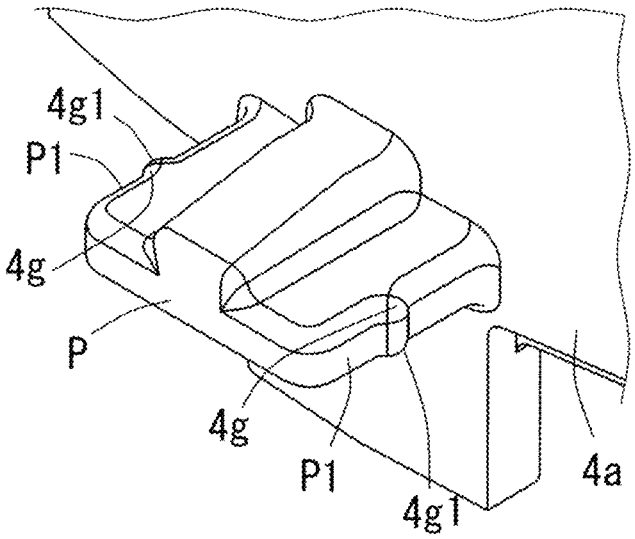
FIG. 10 is a perspective view of a first fitting part of the first case.
Figure 11:
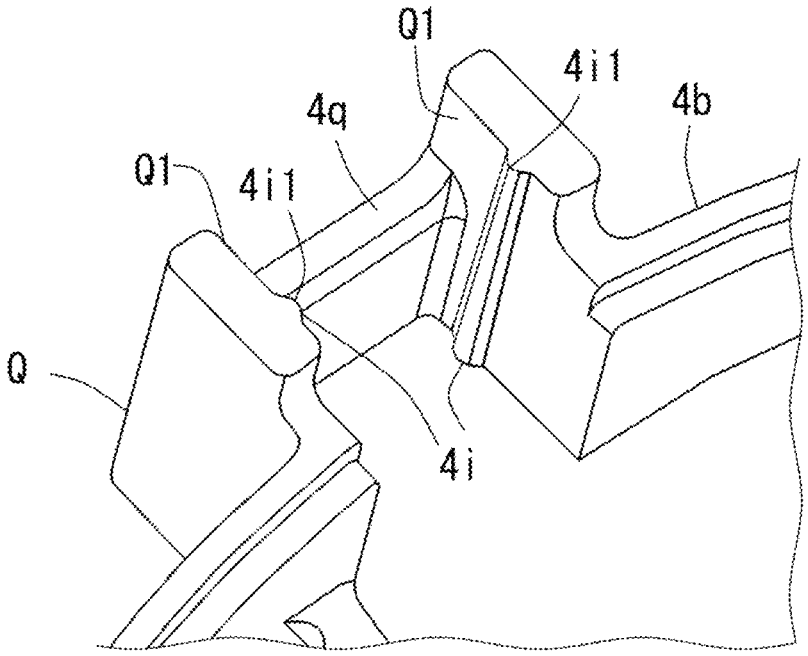
FIG. 11 is a perspective view of a second fitting part of the second case.

As illustrated in FIG. 10, the first ridge 4*g* whose curved surface bulges in a rugby-ball shape is provided to each of both circumferential-direction side walls P1 of the first fitting part P, so as to extend in a thickness direction. Moreover, as illustrated in FIG. 11, on each of the facing surfaces of the circumferential-direction both-side standing walls Q1 of the second fitting part Q, the second ridge 4*i* whose width is narrower at an axial-direction one-end side (opening side), and gradually becomes wider toward the axial-direction other-end side (bottom part side), is formed. The center lines of the first ridge 4*g* and the second ridge 4*i* extend in parallel to the axial direction, and the first ridge 4*g* and the second ridge 4*i* overlap with each other in the radial direction. A top part 4*g*1 presses the facing wall surface Q1, a top part 4*i*1 presses the facing wall surface P1, and the first ridge 4*g* and the second ridge 4*i* mesh with each other while the top parts and the wall surfaces respectively facing to each other in the circumferential direction press against each other (see FIG. 9). As described above, when the first fitting part P and the second fitting part Q are concave-and-protrusion fitted to each other, rattling does not occur in the circumferential direction, the radial direction, and the axial direction of the case body 4.

In detail, on each of the both circumferential-direction side walls P1 of the first fitting part P, the first ridge 4*g* in which the center line is in parallel to the axial direction, and the top part 4*g*1 has a curved-surface shape and continues in the thickness direction, is projectingly provided. The first ridge 4*g* does not necessarily have the same width along the thickness direction, but may have different widths along the thickness direction. Moreover, on each of the standing walls Q1 facing to each other at the both circumferential-direction sides of the second fitting part Q, the second ridge 4*i* in which the center line is in parallel to the axial direction, and the top part 4*i*1 has a curved-surface shape and continues such that the width is narrower at the axial-direction one-end side (opening side) and becomes gradually wider toward the axial-direction other-end side (bottom part side), is projectingly provided.

Therefore, only by the first case 4*a* and the second case 4*b* being overlapped with each other in the axial direction, the first ridge 4*g* and the second ridge 4*i* fit to each other while being in contact in the radial direction. Thus, rattling does not occur in the radial direction of the case body 4. The top part 4*g*1 of the first ridge 4*g* presses the facing wall surface Q1, the top part 4*i*1 of the second ridge 4*i* presses the facing wall surface P1, and the first ridge 4*g* and the second ridge 4*i* fit to each other while the top parts and the wall surfaces respectively facing to each other press against each other. Thus, rattling does not occur also in the circumferential direction of the case body 4. Moreover, the first ridge 4*g* is fitted along the inclined surface of the second ridge 4*i* formed to have the narrower width at the opening side, and have the gradually wider width toward the bottom part side, and the meshing between the ridges is the strongest at the fitted position. Thus, rattling does not occur also in the axial direction of the case body 4.

Note that the meshing of the first ridge 4*g* gets more secured along the tapered-shaped inclined surface of the second ridge 4*i* which is formed to have the narrower width at the opening side and the wider width at the bottom part side. Therefore, as indicated by arrows in FIG. 9, the first case 4*a* increases the pressing toward the radial-direction inner side, and the second case 4*b* increases the pressing toward the radial-direction outer side. Thus, operation and effects that the locking state between the lock piece 4*j* and the lock part 4*k* which constitute the snap-fit becomes more rigid, can be achieved.

As described above, the lead wire opening part 4*q* is formed by the first fitting part P and the second fitting part Q being fitted together. Therefore, only by the first ridge 4*g* and the second ridge 4*i* being formed at the outer and inner walls of the first fitting part P and the second fitting part Q, respectively, rattling after assembly of the case body 4 can be prevented from occurring without an additional member being provided.

Moreover, the case body 4 is assembled by the elastically deformable lock piece 4*j* provided to the outer-peripheral side part of the first case 4*a* being locked to the lock part 4*k* provided to the outer-peripheral side part of the second case 4*b*. At this time, the assembly can be achieved by the snap-fit in which the first case 4*a* and the second case 4*b* are overlapped with each other in the axial direction, and the lock piece 4*j* is elastically deformed to be locked to the lock part 4*k*, which makes assemblability favorable. In addition, by the meshing between the first ridge 4*g* and the second ridge 4*i* being made more secured, the locking state between the lock piece 4*j* and the lock part 4*k* gets firmer, thus the locking state of the snap-fit can be reinforced.

Although the above embodiment is described while taking a vehicle-mounted seat air conditioning as an example, the embodiment is not limited to this, but it may be used for a centrifugal blower for HVAC (Heating, Ventilation, and Air Conditioning), and the like. Needless to say, even at a location other than vehicles, where remaining space is small and space for disposing a conventional air-conditioning air blower is difficult to be secured, the present invention is similarly applicable.

What is claimed is:

1. A centrifugal blower including a case body that accommodates therein a centrifugal fan and a motor adapted to rotary drive the centrifugal fan, and configured to draw in air from a radial-direction middle part of the case body and discharge compressed air from a radial-direction outer side of the case body, wherein the case body includes:

a first case configured to be assembled to cover the centrifugal fan, and provided with an intake opening part at the radial-direction middle part, and a first air blowing path formed at the radial-direction outer side; and a second case configured to axially support the motor to be rotatable, and provided with a second air blowing path formed on an outer side of an outer-peripheral end part of the centrifugal fan in a radial direction, the second air blowing path being configured to be combined with the first air blowing path, and the case body is assembled by a first fitting part provided to the first case and a second fitting part provided to the second case being concave-and-protrusion fitted to each other, a first ridge and a second ridge in which center lines extend in parallel to an axial direction being overlapped with each other in the radial direction at wall surfaces of the first fitting part and the second fitting part facing to each other, and the first ridge and the second ridge meshing with each other while top parts thereof pressing the wall surfaces facing to each other in the circumferential direction, at each of circumferential-direction both side walls of the first fitting part provided projectingly in a plate shape from an outer-peripheral edge part of the first case, the first ridge in which the top part has a curved-surface shape and continues in a thickness direction is formed, at each of both standing walls of the second fitting part having a concave shape and to be fitted to the first fitting part, the second ridge in which a width is narrower at an opening end side, and gradually becomes wider toward a bottom part side, is formed.

2. The centrifugal blower according to claim 1, wherein a lead wire opening part from which a lead wire of the motor is led out is formed by the first fitting part and the second fitting part being fitted together.

3. The centrifugal blower according to claim 1, wherein the case body is formed by the first case and the second case being overlapped with each other in the axial direction, and an elastically deformable lock piece provided to an outer-peripheral side part of the first case being locked to a lock part provided to an outer-peripheral side part of the second case.

* * * * *